United States Patent [19]

Senchuck

[11] Patent Number: 5,033,493

[45] Date of Patent: Jul. 23, 1991

[54] COLLAPSIBLE UTILITY SHACK

[76] Inventor: Earl L. Senchuck, 207 W. Arch St., Marquette, Mich. 49855

[21] Appl. No.: 431,285

[22] Filed: Nov. 3, 1989

[51] Int. Cl.[5] ..... E04H 15/48; E04H 15/36; E04H 15/56

[52] U.S. Cl. ..... 135/113; 135/102; 135/116; 135/901; 52/69; 52/143

[58] Field of Search ..... 135/113, 901, 116, 102, 135/88; 52/69–70, 143; 160/351; 217/46, 47

[56] References Cited

U.S. PATENT DOCUMENTS

| | | | |
|---|---|---|---|
| 3,028,872 | 4/1962 | Cresswell | 135/102 |
| 3,352,313 | 11/1967 | Kroening | 135/116 |
| 3,441,037 | 4/1969 | Transeau | 135/102 |
| 3,629,982 | 12/1971 | Ballay et al. | 52/69 |
| 3,739,536 | 6/1973 | Ward | 52/63 |
| 3,826,270 | 7/1974 | Hentges | 135/901 X |
| 3,935,684 | 2/1976 | Frommelt et al. | 135/115 X |
| 3,971,395 | 7/1976 | Lipinski | 135/4 |
| 4,067,347 | 1/1978 | Lipinski | 135/4 |
| 4,120,067 | 10/1978 | Hone et al. | 135/103 X |
| 4,202,146 | 5/1980 | Adams | 52/143 X |
| 4,438,940 | 3/1984 | Hunt | 52/143 |
| 4,631,877 | 12/1986 | Molodecki | 52/143 X |
| 4,802,500 | 2/1989 | Davis et al. | 135/97 |

FOREIGN PATENT DOCUMENTS

| | | | |
|---|---|---|---|
| 163632 | 8/1954 | Australia | 217/46 |
| 790920 | 7/1968 | Canada | 135/88 |
| 2124855 | 12/1972 | Fed. Rep. of Germany | 135/116 |

*Primary Examiner*—David A. Scherbel
*Assistant Examiner*—Deborah McGann Ripley
*Attorney, Agent, or Firm*—Charles W. Chandler

[57] ABSTRACT

A collapsible shelter has a pair of floor panels hinged together edge-to-edge, and front and rear wall panels hinged along the outer edges of the floor panels such that when the floor panels are collapsed in a side-by-side relationship, the wall panels are disposed closely adjacent one another. When the floor panel is unfolded and the wall panels are disposed in an upright position, various forms of covers may be mounted on the edges of the wall panels to form a shelter.

19 Claims, 5 Drawing Sheets

COLLAPSIBLE UTILITY SHACK

BACKGROUND OF THE INVENTION

This invention is related to collapsible shelters useful for a variety of purposes. The shelter includes a rigid framework with easily attachable and removable covers. The purpose of the shelter determines the cover.

U.S. Pat. No. 4,802,500 which issued in 1989 to Davis, et al. entitled "Portable, Collapsible Building System of Modular Construction", discloses a portable building which folds to the size of a suitcase. Davis requires two suitcase units to make a shelter. Each unit has a floor piece and one end. The units are fastened together along the floor. A roof beam supports a cover extended between the ends.

U.S. Pat. No. 3,739,536 issued in 1973 to Ward entitled "Knock-Down Shelter" discloses a tent-like shelter with rigid end walls and a fabric cover. The floor hinge runs the length of the shelter. The ridge portions of the shelter are constructed of plywood.

U.S. Pat. No. 3,629,982 issued in 1971 to Ballay, et al. entitled "Portable, Foldable Shelter" discloses a shelter that unfolds from a center unit. The shelter unfolds from both sides of the center unit. The center unit acts as a storage space for the roof beams, cover, floor and end walls. The floor does not pivot upwardly to collapse the shelter.

U.S. Pat. No. 3,971,395 issued in 1976, and U.S. Pat. No. 4,067,347 issued in 1978 to Lipinski entitled "Collapsible Self-Storing Shelter" and "Solar Heated Shelter with Moveable Secondary Roof" each disclose shelters with foldable end walls and flexible covers.

SUMMARY OF THE INVENTION

The preferred embodiment of the invention is a lightweight, multipurpose collapsible and portable utility shelter. It has a basic rigid framework, when opened, for easily attaching a removable cover. Different covers are available to provide different functions.

The preferred shelter is assembled as a component structure that provides a high structural strength to weight ratio. The end walls are of a lightweight tubular framework to which a skin is affixed. The floor is a composite sandwich of a structural core material bonded to thin sheets of fiberglass reinforced plastic.

The invention utilizes different covers. The materials for each cover depends upon the function of the shelter. The floor panels are formed of a structural paper core with a reinforced plastic skin. The end walls and floors have a tubular frame to provide maximum structural support with low weight.

The floor has two panels hinged together, edge-to-edge. The end walls have an identical border, preferably with rounded upper edges so that when covered, the shelter has a reduced wind resistance by creating an air foil effect. Each end wall has a door opening with a hinged door for passage into or out of the shelter.

Each end wall has vertical and horizontal tubular structural ribs allowing minimum lateral flexibility. The end walls have top and bottom vents. The vents are inset with a vent plate cover that, when turned from the inside, provides a variable closure to adjust the ventilation. The vent plate also includes a screen barrier to prevent passage of insects.

The doors are hinged in such a way that, when the shelter is properly positioned with respect to the wind, the shelter deflects rather than catches the wind. A replaceable porthole window is included in each door. It is a clear plexiglass sheet held in place with a snap ring. The door latch is a horizontally sliding latch mechanism operable from either the inside or the outside.

One of the end walls is adapted to be attached to skis.

The top of each end wall has a receptacle for fitting an expandable rod. The rod provides an outward force against the fitted cover, thereby giving the shelter a stiff but slightly flexible support.

Each floor panel has a removable insert to allow access through the bottom of the shelter for fishing or the like.

The shelter can be collapsed without necessarily removing the cover. The shelter can be folded up accordion style and then transported by hand, utilizing a handle set in the door.

The floor panels can be anchored to the earth by anchor means, inserted through holes in the floor panels.

The covers are rectangular in shape and are attached by Velcro means to the edges of the front and rear walls and across the floor panel edges in a continuous manner. Snaps may be used instead of a Velcro fastener.

The shelter can be easily used as a tent. It is portable on top a vehicle. The shelter allows one to literally set up camp in seconds, requiring less than 30 seconds to erect. There are no tent pegs to pound or cables to set up. The user can cook or stand up inside the shelter while having maximum protection from the elements. It can be used either by summer or winter campers.

The shelter can be used as a storage shed, useful as a semi-permanent or temporary storage facility, such as on a construction site for storing mortar mix, etc. In this configuration, shelves can be mounted on the end walls.

The shelter can be used as a child's playhouse because it is quick to set up, and safe for children to play house. Their voices transmit through the cover for periodic monitoring. There are no sharp edges to worry about. The doors can be opened from either side.

The shelter can be used for emergency purposes. It can be transported in quantity to a disaster site for homeless victims. Twenty shelters, when folded, occupy only 20 square feet of floor space.

A shelter can be used as a warm-up shack, on ski hills or cross-country ski races and other winter events.

The shelter can be used as a fishing shanty. The advantages over many other commercially-available fishing shanties is that it has a floor, can be quickly set up, and can be set up in the wind. It is lightweight and has few parts, making towing on the ice easy. The shelter, on skis, becomes a vehicle for transporting heaters, bait, augers and other fishing supplies. It is airtight with adjustable ventilation capabilities. When not in season, the shelter can be easily stored under a bed or in a garage. The removable inserts in the floor panels allow access to the fishing holes and serve as seats. These can be replaced when used for other functions. The cover, for this function, has a clear plastic detachable window for monitoring outdoor activities or "tip-ups".

The shelter can be used as a deer blind, a duck blind or a blind for naturalists and outdoor photographers. Preferably the cover for this function has a camouflaged design. A camouflage cover acts as a safety feature when the shelter is used as a fishing shanty, by providing a high contrast against the snow for snowmobilers traveling at speeds at night.

The shelter can be employed as a kennel. For this option, the cover may be a woven, braided wire, steel mesh attached on the outer edges of the floor and wall panels with hook and loop fastener and snap means. The mesh allows maximum protection for the animal and prevents escape.

The shelter can also be used as a playpen for infants providing substantial crawling space and maximum visibility for the baby and mother, complete protection for the baby.

The shelter can be employed as a greenhouse by using a plastic cover that can transmit ultraviolet radiation, has lasting durability and which can withstand high humidity.

In this configuration, shelves are connected to the end walls. The shelves provide additional rigidity thereby relieving stresses on the cover over a long period of continuous use. Preferably five levels of shelves, 16" deep and 7 ft. across are available for growing on both sides of the greenhouse. The end wall doors provide a walk-through passageway for easy tending. The vents provide controlled ventilation. Several greenhouses can be connected to satisfy commercial ventures, or an individual greenhouse adopted for home use by herbalists, horticulturists or hobbyists.

With the ski option attached, the shelter can be used as a winter camping shelter which is better than a tent because the shelter itself provides a platform mechanism to transport other camping supplies. It is easily towed by hand, and even more easily by snowmobile.

The shelter can be used as a sauna by adding a small steam heater.

The shelter can be used as an insect-proof shelter by providing a mosquito net cover. It permits the user to perform tasks, sleep or socialize in an insect-free environment.

The shelter can be employed as a solar collector by providing a cover which is part black plastic and part transparent plastic. The clear side faces the sun. Heated air can be transferred to the living space by a vent fan.

The shelter can be employed as a "Port-a-John". This option requires a cover of opaque material. In this case, the shelter may be mounted on a reservoir tank.

The shelter can be used as a chamber for companies involved in handling toxic or hazardous materials, providing their personnel a chamber to change clothes. Several shelters can be interlocked together thus providing one chamber for removing contaminated protective clothing, the next for showering, and the third for changing into street clothes.

A shelter can be used for military applications for housing personnel during land based, overnight operations, such as bivouacs, or war zone encampments. The shelter can be used with a white cover to disappear against a snowy backdrop. As a first aid station, it can be set up on a moments notice, or as a portable on-site kennel for guard dogs.

The shelter employs the use of a foam bumper guard to protect the outer edges when being towed. This bumper guard also is used as a car top carrier when re-snapped to the end wall facing.

Wheels can be attached to the shelter to provide means for transporting the shelter with supplies to a hunting site or the like.

Still further objects and advantages of the invention will become readily apparent to those skilled in the art to which the invention pertains upon reference to the following detailed description.

DESCRIPTION OF THE DRAWINGS

The description refers to the accompanying drawings in which like reference characters refer to like parts throughout the several views and in which.

DESCRIPTION OF THE PREFERRED EMBODIMENT

Figure 1:
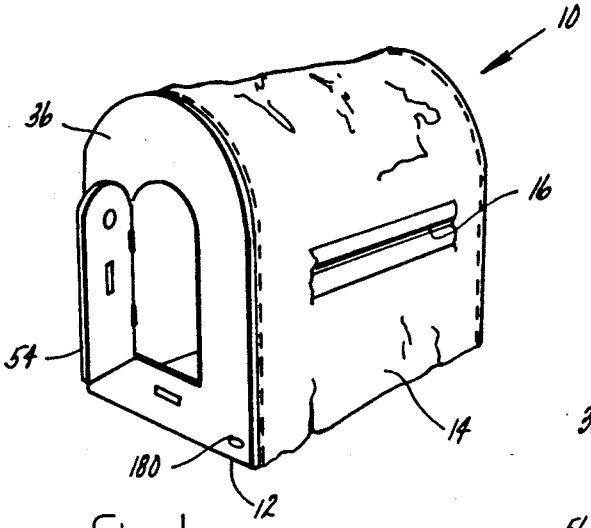
FIG. 1 illustrates a shelter illustrating the preferred embodiment of the invention in its open position.

Referring to the drawings, FIG. 1 illustrates a collapsible shelter 10 which comprises a supporting framework 12 and a fabric cover 14. Cover 14 has a port 16 so that the user can view exterior objects.

Figure 2:
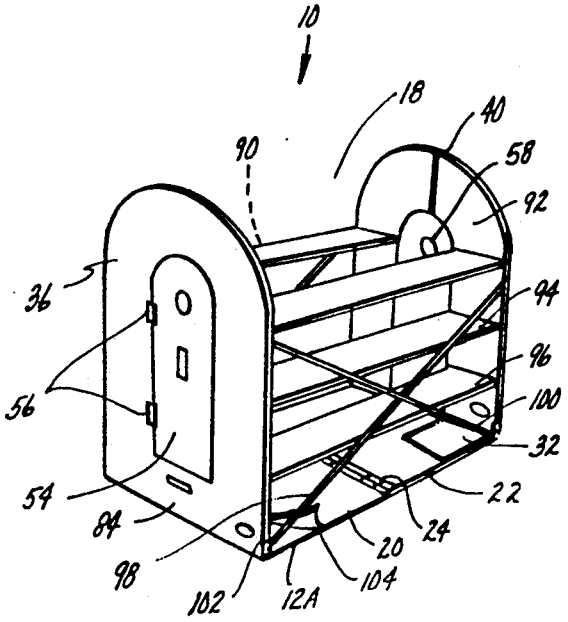
FIG. 2 illustrates the shelter of FIG. 1 but with a transparent cover.
Figure 4:
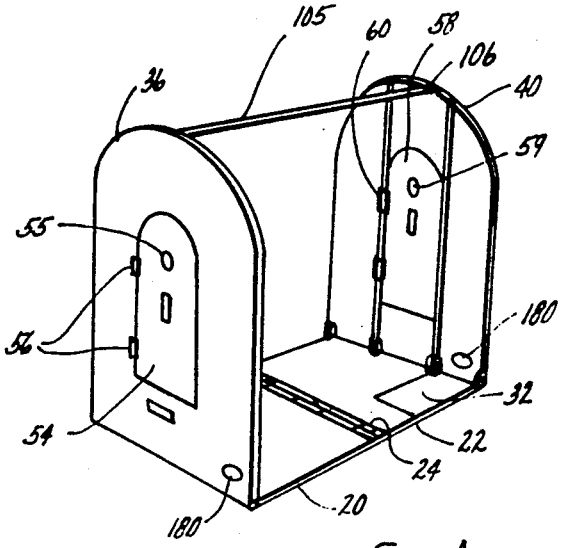
FIG. 4 is a view similar to FIG. 3, but with the top beam and end wall panels in position.

FIG. 2 illustrates shelter 10 formed by supporting framework 12A and a transparent cover 18 so that the shelter forms a collapsible greenhouse. The differences between frame 12 and 12A are illustrated in FIGS. 2 and 4.

In each case, the framework comprises a pair of rectangular floor panels 20 and 22 connected by hinge means 24. Floor panels 20 and 22 are disposed edge-to-edge. Hinge means 24 are so connected as to permit the two floor panels to fold toward one another, as illustrated in FIG. 6, to a fully collapsed position in which they are disposed closely adjacent and parallel to one another, as illustrated in FIG. 7.

Figure 3:
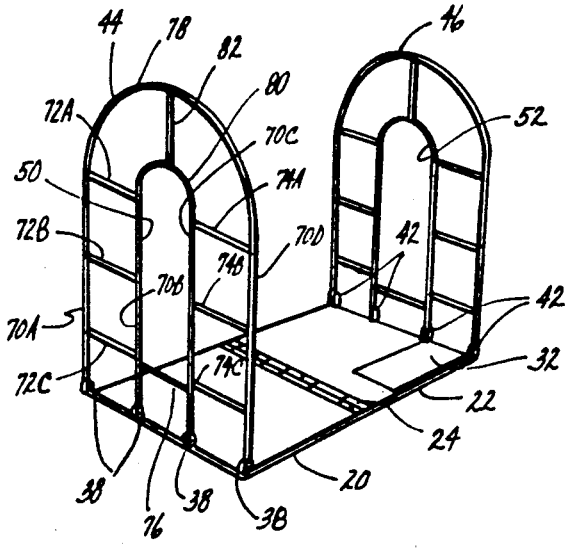
FIG. 3 is a view similar to FIG. 2, but without the cover, shelves, or guy wires.
Figure 6:
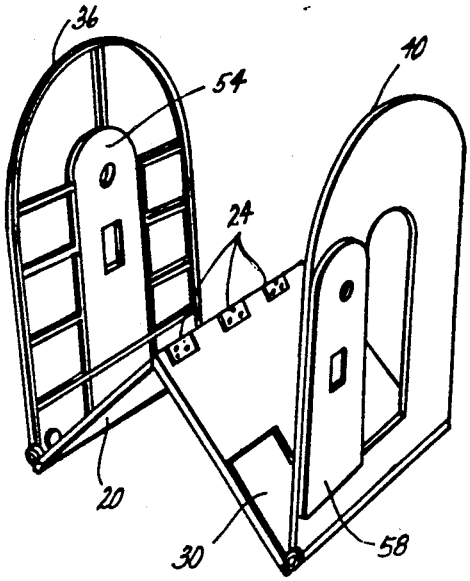
FIG. 6 is a view showing the shelter in a partially collapsed condition.
Figure 7:
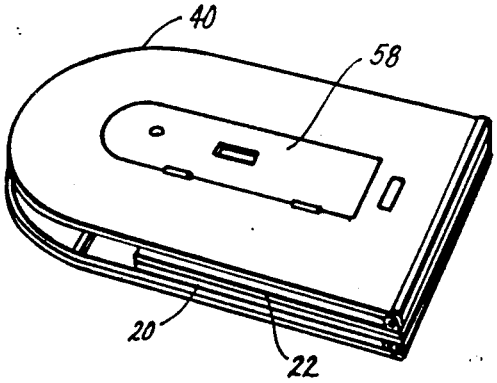
FIG. 7 is a view showing the shelter in a fully collapsed condition and disposed in a horizontal position.

Floor panel 22 has an elongated opening 30, as illustrated in FIG. 6. An insert 32 is mounted in the opening, as illustrated in FIGS. 2, 3, and 4. When the insert is removed from opening 30, the opening can be used for ice fishing.

The other floor panel 20 may also have a similar opening, if desired.

Referring to FIGS. 2–4, a front wall panel 36 is hingedly connected by hinge means 38 to the outer edge of floor panel 20. A rear wall panel 40 is connected by hinge means 42 to the outer edge of floor panel 22. Wall panel 36 has a tubular frame structure 44, and the rear wall panel has a tubular frame structure 46 which is identical to frame structure 44.

The lower ends of each frame structure are connected by hinge means 48, illustrated in FIGS. 12 and 13, and which will be described in greater detail. The front and rear wall panels may be hinged for motion toward an open position, illustrated in FIGS. 2–4, or a fully collapsed position, illustrated in FIG. 7. The front wall panel has a front door opening 50, while the rear wall panel has a rear door opening 52. A door 54 is hingedly mounted by hinge means 56 to front door opening 50, while a rear door 58 is hingedly mounted by hinge means 60 in the rear door opening.

Figure 11:
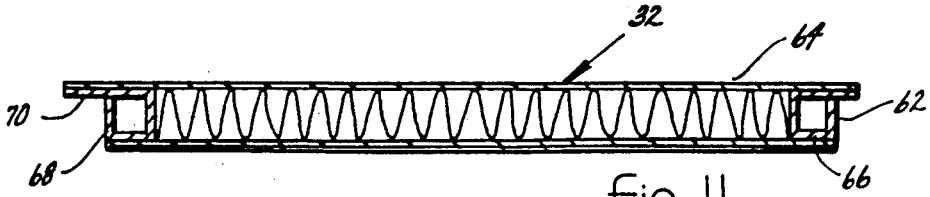
FIG. 11 is a sectional view of the lower insert.
Figure 9:
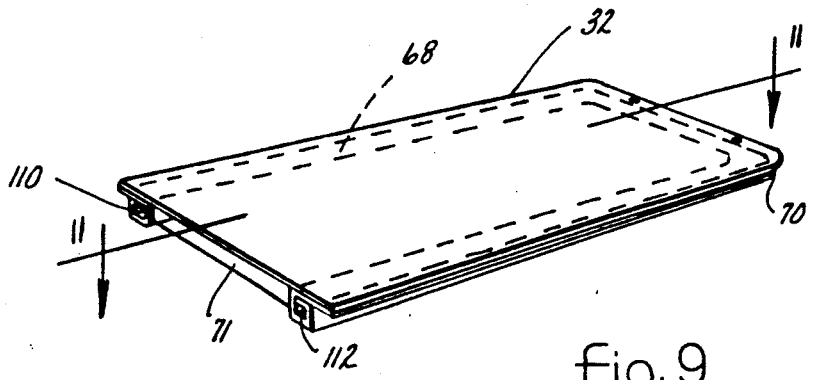
FIG. 9 is a perspective view of the floor panel insert.

FIG. 11 shows the construction of insert 32, and is also illustrative of the composite construction of the floor panels. The insert has an inner structural paper core 62, bonded between fiberglass reinforced plastic skins 64 and 66. The paper core is retained within a tubular framework. Referring to FIG. 9, the tubular framework of the unit has a U-shaped tubular member 68 having a lip 70 extending around three sides of the insert so that the body of the insert may be inserted in the floor opening with lip 70 engaging the upper surface of the floor panel to support the insert. A short tube member 71, without a lip, has its ends attached to the ends of member 68 to complete the fourth side of the frame.

The two wall panels have a similar construction. Front wall panel 36 is typical. Referring to FIG. 3, panel 36 has a tubular framework 44 composed of four elongated, parallel, vertical members 70A, 70B, 70C and 70D. Members 70A and 70B are attached to the opposite ends of three horizontal, parallel frame members 72A, 72B and 72C. Vertical frame members 70C and 70D are attached to the opposite ends of three horizontal short frame members 74A, 74B and 74C. A short horizontal frame member 76 has its ends attached to frame members 70B and 70C to form the bottom of door opening 50. An arcuate frame member 78 has its ends connected to the upper ends of vertical frame members 70A and 70D, while a smaller arcuate frame member 80 has its ends connected to the upper ends of frame members 70B and 70C. A short vertical frame member 82 has its ends attached to frame members 78 and 80, above the door opening. The rear wall panel has an identical frame configuration.

A panel 84 (FIG. 2) of fiberglass reinforced plastic is attached to the outside of the frame member of each wall panel. Panels 84 may be of a transparent material when the shelter is used as a greenhouse. The various tubular frame members each have a square cross-section and are formed of an aluminum construction. Horizontal frame members 72A, 72B and 72C, and 74A, 74B and 74C are aligned with corresponding frame members on the rear wall to support the end of a plurality of shelves illustrated, for example, at 90, 92, 94 and 96 in FIG. 2.

The embodiment of FIG. 2 has shelves for supporting various plants or other materials in the shelter. The shelves can also be used in other forms of the invention.

The shelves cooperate in maintaining the end walls in an erect position. Guy wire 98 has one end releasibly connected to the front wall panel, and its opposite end releasibly connected to the rear wall panel. Similarly a second guy wire 100 has its lower end connected to the rear wall panel and its upper end attached to the front wall panel to cooperate with the other guy wire in maintaining the end wall panels erect. The guy wires are only necessary when the shelves are being used.

Referring to FIG. 2, a fabric hook releasible fastener tape 102, such as a Velcro fastener, is attached around the edge of the front wall panel, along the outer edges of the two floor panels and around the edge of the rear wall panel. Each cover, such as cover 18, has a complementary fabric loop fastener tape 104, such as a Velcro fastener, attached completely around its edge so that the edges of the fabric covers can be readily attached or released from the edges of the floor and wall panels when they are in their raised position. There are a number of detachable mechanisms available which can be used such as snap fasteners.

In the embodiment of the invention of FIG. 4, an expandable beam 105 is releasibly connected to the upper edges of the front and rear wall panels by bracket means 106, to support the two wall panels in their raised, vertical, parallel positions.

Front door 54 preferably has an opening with a transparent cover 55 (FIG. 4), while the rear door has a opening with a transparent cover 59 to permit the user to view the environment outside of the shelter.

Figure 5:
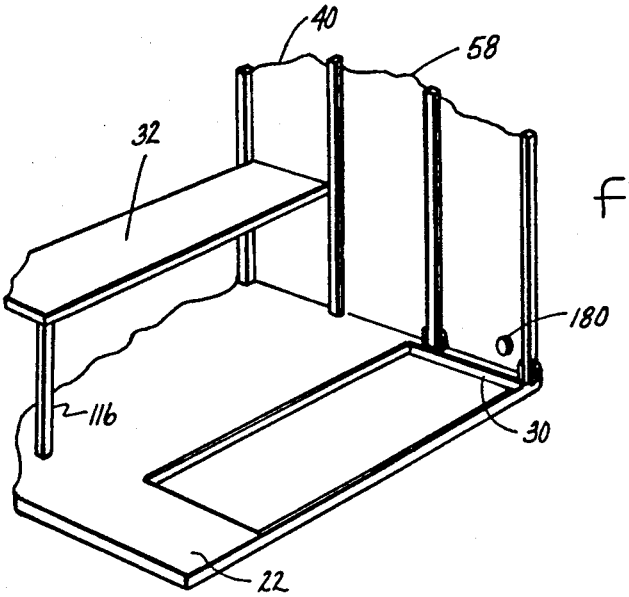
FIG. 5 is a view showing the fish hole cover insert used as a seat.
Figure 10:
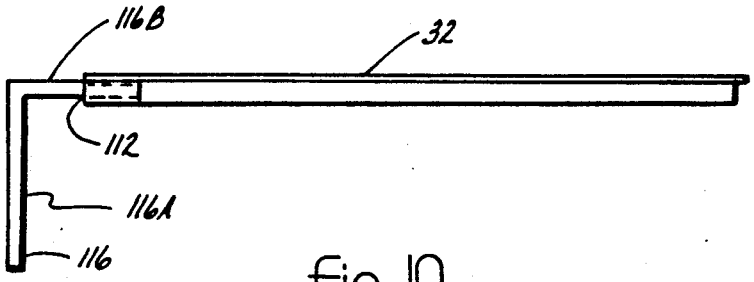
FIG. 10 is another view of the fish hole insert with legs for supporting it as a seat.

Referring to FIG. 9, the tubular frame member 68 has a pair of square end openings 110 and 112. A pair of identical leg means 116 (FIG. 10) are connected to the insert. Each pair of leg means 116 has a vertical component 116A and a horizontal component 116B. The horizontal components are inserted in openings 110 and 112 so that the two legs cooperate in supporting one end of the insert while the other end is mounted on one of the horizontal wall frame members, as illustrated in FIG. 5. The insert then forms a seat for the user while he is fishing through opening 30. When legs 116 are not in use they can be stored in panel 36 or panel 40.

Figure 12:
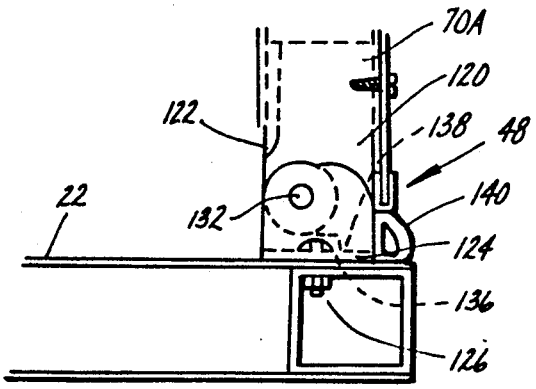
FIGS. 12–13 are views of the hinge assembly for connecting the wall panels to the floor panel.
Figure 13:
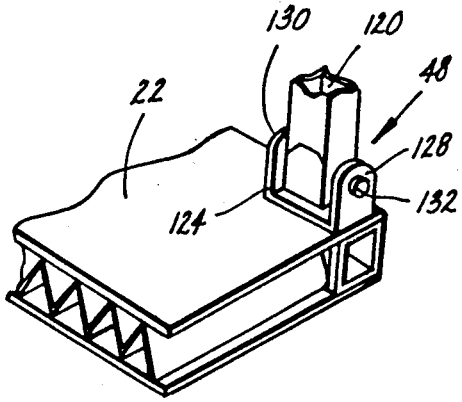

FIGS. 12 and 13 illustrate typical hinge means 48 for connecting the wall panels to the floor panels. The hinge means include a cast aluminum hinge plug 120 inserted in the bottom of a vertical frame member, such as 70A. Plug 120 has a channel (or groove) 122 which has one end disposed inside the vertical frame member, and its other end extending below the frame member to provide for downward flowing condensate discharge.

A hinge block (or bracket) 124 is fastened by a pop rivet 126 to a floor frame member. The hinge block has a pair of lugs (arms) 128 and 130 supporting hinge pin 132 which passes through the hinge plug to support it for pivotal motion. The hinge plug has an abutment 136 which engages an abutment 138 on the base of the hinge block 124 to limit the swing of the frame member when it has been raised to an upright position. The hinge plug, together with the wall panel frame, is pivotally movable toward the floor panel, as illustrated in FIGS. 6 and 7. Resilient trim lock 140 is mounted to the bottom edge of the wall panel. The trim lock contacts floor panel 22 (FIG. 12) to maintain inside ambient integrity.

Figure 14:
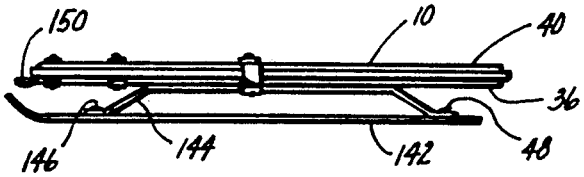
FIG. 14 is another view of the collapsed shelter mounted on skis.

Elongated metal bracket means 144 (FIG. 14) are attached to wall panel 36. The ends of the bracket means are attached at 146 and 148 to the skis 142. In this embodiment, the collapsed shelter forms a platform for carrying materials over ice and snow. Wall panel 36 has a towing tongue 150 for pulling the platform and its load.

Figure 8:
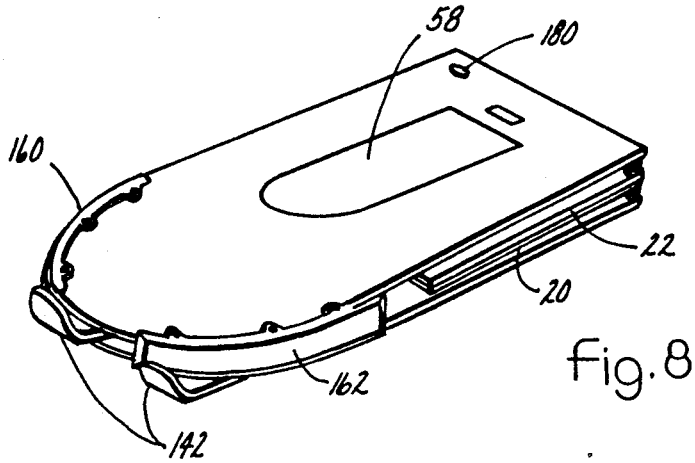
FIG. 8 is a view showing the collapsed shelter mounted on skis.
Figure 15:
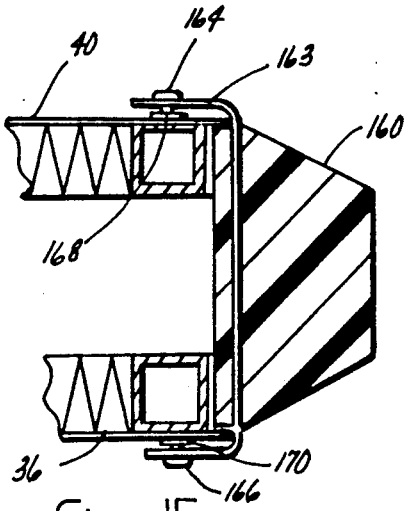
FIG. 15 is an enlarged sectional view of the bumper as seen along lines 15—15 of FIG. 14.

Referring to FIG. 8 and 15, a pair of identical bumper members 160 and 162 are mounted on the curved portions of the wall panels adjacent the leading ends of the skis. Referring to FIG. 15, which is a cross-section through bumper 160, the bumper has a frustoconical cross section. The base of the bumper is connected to a plurality of plastic coated, canvas, elongated, connecting elements, such as at 163. Each connecting element 163 has a pair of snaps 164 and 166. Snap 164 is releasibly fastened to a complementary snap 168 mounted on the framework of panel 40. Snap 166 is releasibly fastened to a complementary snap 170 attached to panel 36. The arrangement permits the base of the bumper to be mounted between the outer skin of the two wall panels.

The snaps permit the bumper elements to be easily mounted in position when the shelter is being used in a ski or sled load-carrying configuration. The bumper elements can be removed and resnapped to the panel opposite the skit mount side to serve as a car top carrier.

Each wall panel has a bottom vent means 180 (FIGS. 4 and 5), for passing moisture from the shelter.

A fold-out shelf (not shown) can be mounted within the framework of each end wall panel for supporting beverages, flashlights, tackle and the like. The shelf folds into the recesses of the tubular framework, when not in use. A swing-aside coat hanger (Not shown) can also be similarly mounted.

Figure 18:
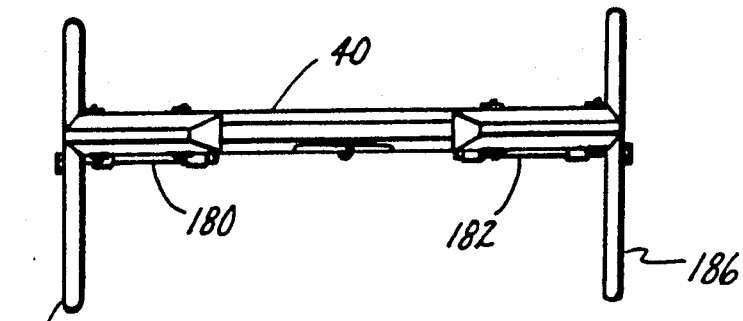
FIGS. 16–18 illustrate the wheeled version of the invention.
Figure 16:
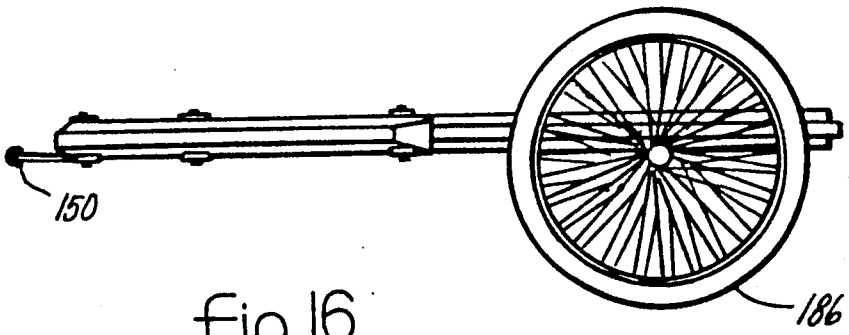
Figure 17:
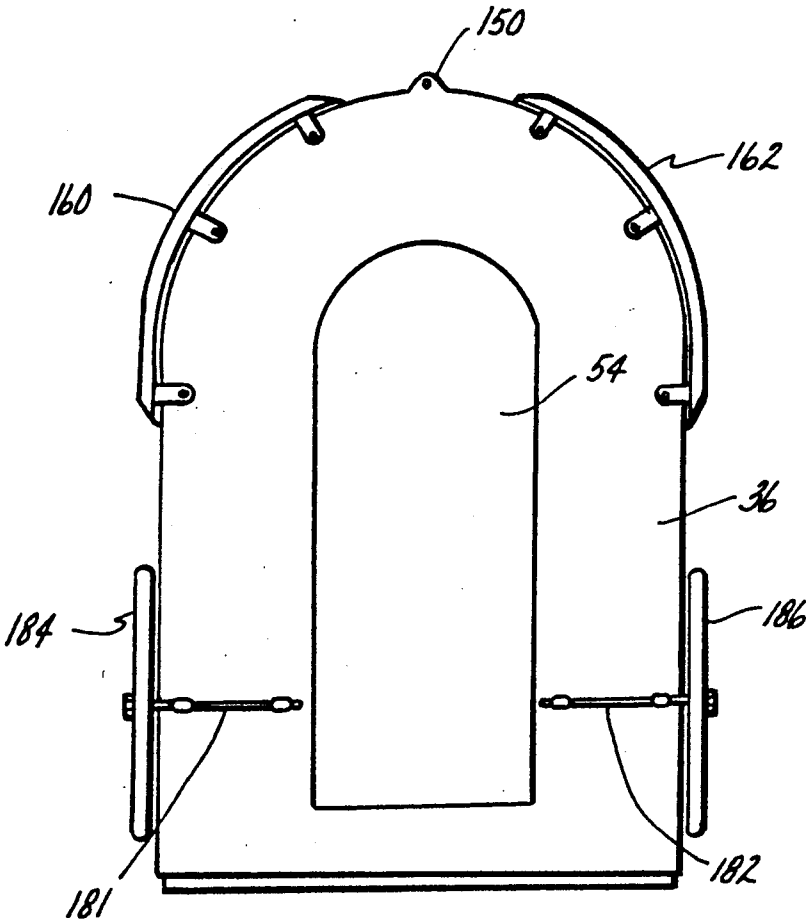

FIGS. 16–18 illustrate another form of the invention in which the collapsed shelter has a pair of axle means 181 and 182 mounted on the lower side of panel 40. A pair of spoked wheels 184 and 186 are rotatably mounted on the outer ends of axle means 181 and 182, respectively. Thus the collapsed shelter can be used for supporting its own weight as well as carrying a load such as supplies or even a heavy animal when the user is hunting.

Having described my invention, I claim:

1. A collapsible shelter, comprising:

a pair of similarly-shaped floor panels, and first hinge means connecting the pair of floor panels together edge-to-edge such that they may be moved between either an open position in which the floor panels are disposed in a generally common plane, or folded to a collapsed position in which they are disposed in a side-by-side, generally parallel position;

a front wall panel and a rear wall panel, second hinge means connecting the edge of the front wall panel to one of said floor panels, and third hinge means connecting the edge of the rear wall panel to the second of said pair of floor panels such that as the front wall panel is moved toward the rear wall panel and a parallel relationship thereto, the floor panels are folded toward their collapsed position in which they are totally disposed between the front wall panel and the rear wall panel;

a cover, and means connecting same around the edges of both the front wall panel and the rear wall panel, whereby the cover, the floor panels, and front and rear panels combine to form an enclosure at such times as the floor panels are in said open position, and the front and rear panels are in an upright position generally at right angles to the floor panels.

2. A collapsible shelter as defined in claim 1, in which the first hinge means, the second hinge means, and the third hinge means, are each foldable about respective hinge axis that are disposed in spaced, parallel relationships, one with the other.

3. A collapsible shelter as defined in claim 2, including brace means connected to the front wall panel and the rear wall panel for preventing them from swinging either toward or away from their upright positions.

4. A collapsible shelter as defined in claim 3, in which the brace means comprises a beam having one end connected to the front wall panel, above the floor panels, and its opposite end connected to the rear wall panel, above the floor panels.

5. A collapsible shelter as defined in claim 1, including an opening in at least one of said floor panels, and an insert removably mounted on the floor panel to close said opening, and including leg means adapted to be connected to the insert to cooperate in supporting it in a raised position extending from a wall panel to form a seat for the user.

6. A collapsible shelter as defined in claim 1, including a shelf removably mounted between and connected to the front and rear wall panels.

7. A collapsible shelter as defined in claim 1, in which the cover is formed of a generally transparent plastic material to form a greenhouse when mounted on the front and rear wall panels.

8. A collapsible shelter as defined in claim 1, including a releasible fastener means mounted around the edge of the front and rear wall panels for connecting the cover to said wall panels.

9. A collapsible shelter as defined in claim 1, wherein said cover is a flexible fabric material that is connected to said wall panels and floor panel, such that the panels can be moved between the collapsed position and the open position without disconnecting the fabric cover from the panels.

10. A collapsible shelter as defined in claim 1, wherein each wall panel comprises a tubular framework that includes four elongated straight parallel frame members; two of said parallel frame members defining said edges of the respective wall panel; the other two parallel frame members defining a door opening.

11. A collapsible shelter as defined in claim 10, wherein each said tubular framework further comprises a first arcuate tubular frame member interconnecting said two parallel frame members to form an upper edge of the respective wall panel, and a second arcuate tubular frame member interconnecting said other two parallel frame members to form an upper limit of the respective door opening.

12. A collapsible shelter as defined in claim 11, wherein each said second hinge means and each said third hinge means comprises four separate hinge structures; each said separate hinge structure comprising a plug member telescopically extending into an end of a respective one of said four elongated straight parallel frame members, a U-shaped bracket secured to a floor panel, said bracket having two upstanding arms extending alongside an associated plug member, and a hinge pin extending through said arms and the plug member to define the hinge structure swing axis.

13. A collapsible shelter as defined in claim 12, wherein each of the elongated straight parallel frame members has a square cross-section, each plug member having a square cross-section mated to the internal dimension of the associated frame member; each said hinge bracket having its upstanding arms spaced apart so that flat side surfaces of an associated plug member are in facial engagement with the bracket arms.

14. A collapsible shelter as defined in claim 1, wherein each wall panel comprises a tubular framework and a relatively thin skin panel element coextensive with the outline configuration of said framework; said tubular framework comprising four elongated straight parallel tubes, two of said tubes defining said edges of the respective wall panel, the other two parallel tubes defining a door opening.

15. A collapsible shelter as defined in claim 14, wherein each tubular framework further comprises a first arcuate tube interconnecting said two parallel tubes to form an upper edge of the respective all panel, and a second arcuate tube interconnecting said other two parallel tubes to form an upper edge of the respective door opening.

16. A collapsible shelter as defined in claim 15, wherein each said tubular framework further comprises a number of transverse frame members extending between said straight parallel tubes in the spaces between the side edges of the wall panel and the side edges of the door opening.

17. A collapsible shelter as defined in claim 16, and further comprising a rectangular opening in one of said floor panels, a rectangular insert removably mounted on said one floor panel to close said opening; said insert comprising two tubular reinforcement elements extending therealong, each tubular reinforcement element having an open end; said rectangular insert having an edge area adapted to rest on one of said transverse frame members when said insert is lifted away from the opening in said one floor panel; and two L-shaped legs having end portions thereof insertable into the open ends of the tubular reinforcement elements to support said insert in a raised position in which it can form a seat for the user.

18. A collapsible shelter as defined in claim 1, wherein each wall panel has a door opening therein permitting access to the shelter when the shelter is in its raised condition; two aligned axles extending along the outer face of one of said wall panels parallel to the axis of the hinge means for said one wall panel; and a ground wheel connected to each axle outboard from said one wall panel, so that when the shelter is in its collapsed condition, it can be towed behind a vehicle in a prone position.

19. A collapsible shelter as defined in claim 18, and further comprising a towing tongue extending from said one wall panel along an imaginary panel centerline taken normal to the ground wheel turning axis.

* * * * *